US006250188B1

(12) United States Patent
Sato et al.

(10) Patent No.: US 6,250,188 B1
(45) Date of Patent: Jun. 26, 2001

(54) ULTRASONIC VIBRATION CUTTING METHOD AND APPARATUS

(75) Inventors: Shigeru Sato; Ryoichi Ishii, both of Fukuoka-ken (JP)

(73) Assignee: Ultex Corporation, Fukuoka (JP)

( * ) Notice: Subject to any disclaimer, the term of this patent is extended or adjusted under 35 U.S.C. 154(b) by 0 days.

(21) Appl. No.: 09/489,028

(22) Filed: Jan. 21, 2000

(30) Foreign Application Priority Data

Jan. 21, 1999 (JP) ..... 11-012930

(51) Int. Cl.[7] ..... B26D 1/00

(52) U.S. Cl. ..... 83/35; 83/13; 83/177; 83/367; 83/368; 83/491; 83/666; 83/956; 451/165

(58) Field of Search ..... 83/13, 22, 24, 83/35, 39, 56, 72, 367, 368, 491, 665, 666, 177, 956; 451/165, 360

(56) References Cited

U.S. PATENT DOCUMENTS

| | | | | |
|---|---|---|---|---|
| 4,343,111 | * | 8/1982 | Inoue | 83/956 X |
| 4,401,001 | * | 8/1983 | Gerber et al. | 83/956 X |
| 5,177,902 | * | 1/1993 | Baba et al. | 451/165 |
| 5,301,587 | * | 4/1994 | Blaimschein | 83/956 X |
| 6,058,823 | * | 5/2000 | Michovo | 83/956 X |

* cited by examiner

*Primary Examiner*—W. Donald Bray
(74) *Attorney, Agent, or Firm*—Kanesaka & Takeuchi

(57) ABSTRACT

An ultrasonic vibration cutting method comprising mounting and fixing a part to be cut on a mounting table, moving down an ultrasonic vibration rotation unit, stopping the downward movement of the ultrasonic vibration rotation unit when the cutting blade of the ultrasonic vibration rotation unit reaches a position for cutting the part, moving the ultrasonic vibration rotation unit linearly for cutting, and turning and vibrating the cutting blade with ultrasonic waves to cut the part.

4 Claims, 5 Drawing Sheets

ULTRASONIC VIBRATION CUTTING METHOD AND APPARATUS

BACKGROUND OF THE INVENTION

1. Field of the Invention

The present invention relates to an ultrasonic vibration cutting method and apparatus.

2. Description of the Prior Art

In the production of semiconductor devices, attempts are being made to cut a semiconductor wafer incorporating IC's and the like into a plurality of dice-like semiconductor chips called "bare chip" with ultrasonic vibration.

However, cutting of a semiconductor wafer into dice-like semiconductor chips with ultrasonic vibration does not succeed yet. There is no example of success in cutting viscous and soft materials such as gold, silver, aluminum, solder and copper, hard and fragile materials such as ceramics, silicon and ferrite, laminate structures consisting of a synthetic resin and a metal, laminate structures consisting of an inorganic material, a metal and a synthetic resin, and the like with ultrasonic vibration.

SUMMARY OF THE INVENTION

It is therefore an object of the present invention to provide an ultrasonic vibration cutting method and apparatus capable of properly cutting parts having the above physical properties.

According to a first aspect of the present invention, there is provided an ultrasonic vibration cutting method comprising the steps of:

mounting and fixing a part to be cut on a mounting table;

moving down an ultrasonic vibration rotation unit:

stopping the downward movement of the ultrasonic vibration rotation unit when the cutting blade of the ultrasonic vibration rotation unit reaches a position for cutting the part;

moving the ultrasonic vibration rotation unit linearly for cutting; and turning and vibrating the cutting blade with ultrasonic waves to cut the part.

According to a second aspect of the present invention, there is provided an ultrasonic vibration cutting apparatus comprising:

a mounting table attached to an apparatus body to fix a part to be cut;

a 3-axis drive unit which is attached to the apparatus body and can move linearly in three directions perpendicular to one another; and an ultrasonic vibration rotation unit attached to the 3-direction output portion of the 3-axis drive unit to cut the part fixed on the mounting table.

According to a third aspect of the present invention, there is provided an ultrasonic vibration cutting apparatus which further comprises cooling means for cooling the cutting blade of the ultrasonic vibration rotation unit and the part to be cut.

According to a fourth aspect of the present invention, there is provided an ultrasonic vibration cutting apparatus wherein an ultrasonic vibration rotation unit comprises a fixed outer shell attached to the 3-direction output portion of a 3-axis drive unit, a rotary inner shell installed in the fixed outer shell rotably, a transducer stored in the rotary inner shell, a circular resonator connected to the transducer and arranged coaxial to the rotary inner shell, a cutting blade projecting outward from one ends of the fixed outer shell and the rotary inner shell of the resonator and provided at the minimum vibration amplitude point, and a drive source attached to the other end of the fixed outer shell to turn the rotary inner shell.

The above and other objects, features and advantages of the invention will become more apparent from the following description when taken in conjunction with the accompanying drawings.

BRIEF DESCRIPTION OF THE ACCOMPANYING DRAWINGS

DETAILED DESCRIPTION OF THE PREFERRED EMBODIMENTS

Embodiment 1

The constitution of Embodiment 1 of the present invention will be described with reference to FIGS. 1 to 7.

Figure 1:
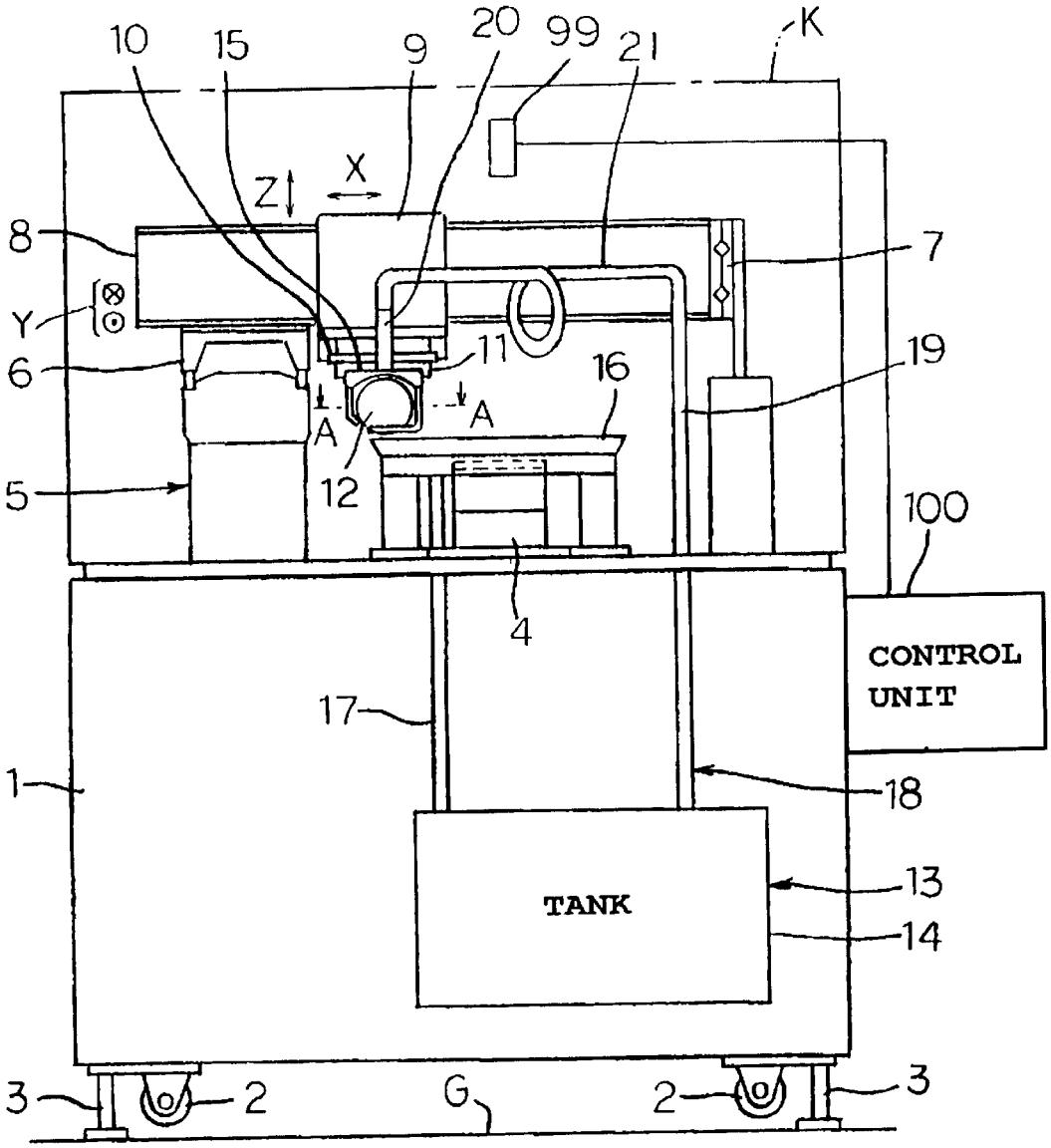
FIG. 1 is a front view of an ultrasonic vibration cutting apparatus according to Embodiment 1 of the present invention.

With reference to FIG. 1, an ultrasonic vibration cutting apparatus will be first described. Reference numeral 1 denotes an apparatus body having wheels 2 for moving and feet 3 for fixing in a lower portion thereof. To move the ultrasonic vibration cutting apparatus, the feet 3 are evacuated into the apparatus body 1, and the apparatus body 1 is pushed or pulled while the wheels 2 are in contact with an installation ground G, whereby the wheels 2 are turned and the apparatus body 1 can move. To fix the ultrasonic vibration cutting apparatus, as shown in the figure, the feet 3 are projected toward the installation ground G more than the wheels 2 and brought into contact with the installation ground G and the wheels 2 float above the installation ground G, whereby the apparatus body 1 can be fixed on the installation ground G. The feet 3 are formed of bolts and nuts so that the horizontally of the apparatus body 1 can be adjusted when the apparatus body 1 is to be fixed on the installation ground G.

Reference numeral 4 denotes a mounting table installed on the top of the apparatus body 1 for mounting and fixing a part to be cut and having the function of adjusting its elevation angle $\phi$ and rotation angle $\theta$. The control of the elevation angle $\phi$ is carried out by adjusting the horizontally of the top surface of the mounting table 4 at three locations with a precision needle actuator called "micrometer head". The control of the rotation angle $\phi$ is carried out by adjusting the direction within the plane of the top surface of the mounting table 4 with an actuator like a rotary table. To fix the part to be cut on the mounting table 4, an adhesive having durability and thermoplasticity against a refrigerant such as colophonium, UV resin or double coated tape, or suction or adsorption may be used. Durability against a refrigerant is a property that even when a refrigerant contacts the adhesive, the adhesive is not dissociated from the mounting table 4 and the part to be cut. Thermoplasticity against a refrigerant is a property that when the part to be cut is a semiconductor wafer, for example, and the adhesive has a high temperature and receives heat at the time of a burn-in test which is carried out in the production process of a semiconductor device, the adhesive is dissociated from the mounting table 4 and the part to be cut. In the case of suction or adsorption, when a suction hole is formed in the top surface of the mounting table 4 and connected to a suction pump which is provided separate from the mounting table 4 by a suction passage and the suction pump is driven, the part to be cut may be fixed on the top surface of the mounting table 4 through the suction hole by opening a valve in the suction passage. Suction holes corresponding to the number of cut pieces of the part may be formed. An annular frame surrounding the part may be provided on the top surface of the mounting table 4 to prevent the scattering of the cut pieces.

Reference numeral 5 represents a 3-axis drive unit which can move linearly in three directions perpendicular to one another and comprises guides 6 and 7 attached to the apparatus body 1 and arranged on both sides of the mounting table 4 with a space therebetween for movement in a front or rear direction, a guide rail 8 located above the mounting table 4 and laid on the movable portions of the guides 6 and 7 for movement in a right or left direction, a movable head 9 installed on the guide rail 8 in such a manner that it can be driven in a right or left direction, a climbing head 10 which is attached to the movable head 9 and moves in a vertical direction, and a holder 11 attached to the climbing head 10. The guide rail 8 is moved linearly along the guide rails 6 and 7 in a direction Y which is the front or rear direction of the paper of FIG. 1 by an unshown actuator such as a step motor without rotating, the movable head 9 is moved linearly along the guide rail 8 in a direction X which is the right or left direction of the paper of FIG. 1 by an unshown actuator such as a step motor without rotating, and the climbing head 10 is moved up or down linearly by one unshown actuator selected from a step motor and air cylinder without rotating with respect to the movable head 9 so that the holder 11 moves to draw a square locus consisting of four straight lines for descent, cutting, ascent and return. Reference numeral 12 denotes an ultrasonic vibration rotation unit set on the holder 11 which is the 3-direction output portion of the 3-axis drive unit 5 to cut the part fixed on the mounting table 4.

Denoted by 13 is a system for cooling the cutting blade of the ultrasonic vibration rotation unit 12 and the part to be cut, which comprises a tank 14, a nozzle unit 15 attached to any one of the holder 11 and the ultrasonic vibration rotation unit 12, a refrigerant receiver 16 arranged around the mounting table 4, a refrigerant return passage 17 connected to the refrigerant receiver 16 and the tank 14, and a refrigerant supply passage 18 connected to the tank 14 and the nozzle unit 15. When an unshown pump provided in the tank 14 is driven while a water or other liquid refrigerant is contained in the tank 14, the refrigerant is supplied from the refrigerant supply passage 18 to the nozzle unit 15 by pressure and sprayed upon the cutting blade of the ultrasonic vibration rotation unit 12 and the part to be cut from the nozzle unit 15 to cool them. The refrigerant after cooling is collected into the refrigerant receiver 16 and returned to the tank 14 through the refrigerant return passage 17. The refrigerant returned into the tank 14 is caused to pass through a filter provided in the tank 14 to separate chips from the refrigerant. The refrigerant from which the chips have been removed is sucked by the pump which supplies the refrigerant to the nozzle unit 15 by pressure. Thus, the refrigerant is recycled. The refrigerant supply passage 18 comprises a solid pipe 19 on the tank 14 side, a solid pipe 20 on the nozzle unit 15 side and a flexible pipe 21 connected to both of the solid pipes 19 and 20. When the ultrasonic vibration rotation unit 12 is to cut the part on the mounting table 4, while the holder 11 moves along the square locus, the flexible pipe 21 expands or contracts in accordance with the moving locus of the holder 11 and the refrigerant is properly supplied to the nozzle unit 15 from the tank 14.

Reference numeral 99 denotes image pick-up means such as a CCD camera which picks an image of the part fixed on the mounting table 4, converts an image signal into an electric signal and outputs the electric signal to a control unit 100. The control unit 100 compares the image signal from the CCD camera 97 with reference image information preset in the control unit 100, calculates displacement between the image signal and the reference image information and drives the function of adjusting the rotation angle θ of the mounting table 4 based on the calculation result. Thereby, the part fixed on the mounting table 4 is accurately positioned with respect to the ultrasonic vibration rotation unit 12 when it is to be cut. Letter K in FIG. 1 denotes a protective cover.

Figure 2:
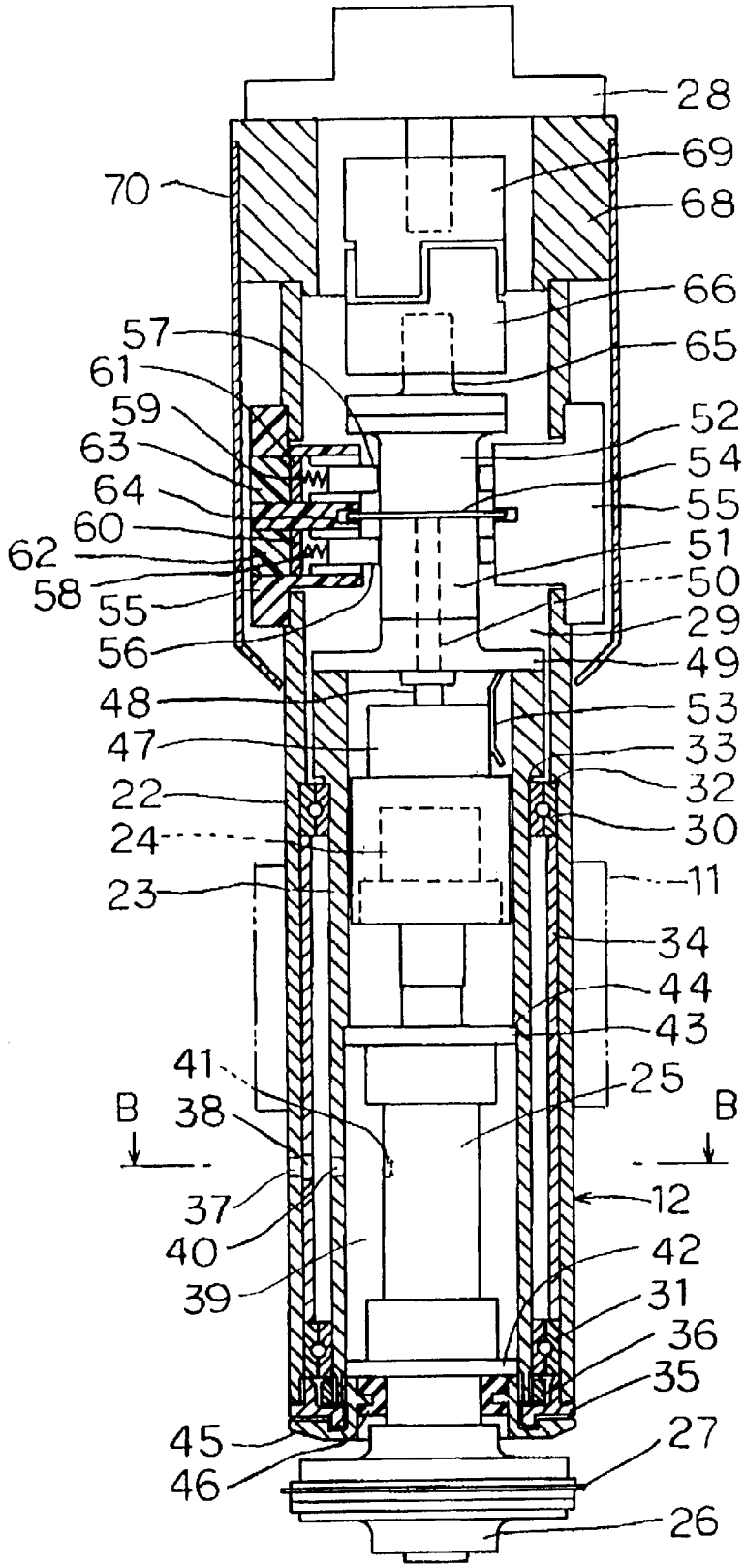
FIG. 2 is a sectional view cut on line A—A of FIG. 1 of an ultrasonic vibration rotation unit of Embodiment 1.
Figure 3:
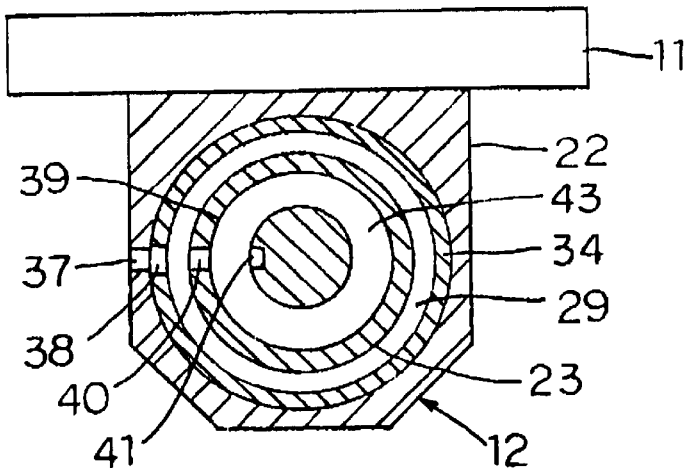
FIG. 3 is a sectional view cut on line B—B of FIG. 2 of the ultrasonic vibration rotation unit of Embodiment 1.

With reference to FIG. 2 and FIG. 3, the ultrasonic vibration rotation unit 12 will be described. Roughly speaking, the ultrasonic vibration rotation unit 12 comprises a fixed outer shell 22 attached to the holder 11 by bolts, a rotary inner shell 23 rotably installed in the fixed outer shell 22, a transducer 24 stored in the rotary inner shell 23, a booster 25 stored in the rotary inner shell 23 coaxially and connected coaxial to the transducer 24 with a screw such as a headless screw, a circular horn 26 connected coaxial to the booster 25 with a screw such as a headless screw and projecting outward from one ends of the fixed outer shell 22 and the rotary inner shell 23, a cutting blade 27 provided on the vibration transmission direction converter of the horn 26 and a motor 28 which is a drive source attached to the other end of the fixed outer shell 22 to turn the rotary inner shell 23. The thickness "t" of the cutting blade 27 is about 2 to 200 μm. The booster 25 and the horn 26 form a resonator.

The fixed outer shell 22 has a storage chamber 29 which extends in front and rear directions. A rear bearing 30 and a front bearing 31 are placed between the rotary inner shell 23 and the fixed outer shell 22 which are inserted into the front half of the storage chamber 29. The outer ring of the rear bearing 30 is received by a stepped portion 32 projecting into the storage chamber 29 of the fixed outer shell 22, the inner ring of the rear bearing 30 is received by a stepped portion 33 projecting from the peripheral surface of the rotary inner shell 23, and a cylindrical bearing sheet 34 is placed between the rear bearing 30 and the front bearing 31. Both ends of the bearing sheet 34 contact the outer ring of the rear bearing 30 and the outer ring of the front bearing 31, respectively. The outer ring of the front bearing 31 is held by an annular outer bearing holder 35 screwed to the inner side of the front end portion of the fixed outer shell 22. The inner ring of the front bearing 31 is held by an annular inner bearing holder 36 screwed to the outer side of the front end portion of the rotary inner shell 23. The outer bearing holder 35 covers the inner bearing holder 36 and the front end of the rotary inner shell 23 with a space smaller than the surface tension of the refrigerant therebetween to prevent the refrigerant from entering the front bearing 31 from the space. The outer bearing holder 35 has an unshown recess for a fastening tool on the front side so that the fastening tool is inserted into the recess to connect the outer bearing holder 35 to the fixed outer shell 22 properly.

The fixed outer shell 22 has a work hole 37 in the wall. The work hole 37 is located closer to the horn 26 than the holder 11. The bearing sheet 34 has an escape hole 38 at a position corresponding to the work hole 37. The rotary inner shell 23 has a storage chamber 39 extending in front and rear directions and a through hole 40 in the wall. The through hole 40 is also located at a position corresponding to the work hole 37. The booster 25 has a recess 41 in the outer wall at a position corresponding to the work hole 37. When the transducer 24 and the booster 25 are to be installed in the rotary inner shell 23, the through hole 40 and the recess 41 are aligned with each other and when the bearing sheet 34 is to be installed on the fixed outer shell 22, the work hole 37 and the escape hole 38 are aligned with each other. When any one of the horn 26 and the cutting blade 27 is to be exchanged, an operator turns the horn 26 manually to check alignment between the work hole 37 and the through hole 40 and then inserts an unshown rod into the recess 41 from the work hole 37 through the escape hole 38 and the through hole 40 to stop the rotations of the rotary inner shell 23 and the booster 25, thereby making it easy to exchange any one of the horn 26 and the cutting blade 27.

The transducer 24 and the booster 25 are placed in the storage chamber 39 of the rotary inner shell 23. While the transducer 24 and the booster 25 are connected to each other, they are inserted into the storage chamber 39 from the front side of the rotary inner shell 23, whereby the transducer 24 is placed in the storage chamber 39 without contact, the booster 25 is inserted into the storage chamber 39 with the outer surface of the front support portion 42 and the outer surface of the rear support portion 43 thereof in contact with the inner wall of the storage chamber 39, and the rear support portion 43 is received by a stepped portion 44 projecting into the storage chamber 39. The transducer 24 and the booster 25 are situated in the storage chamber 39 without being displaced in a radial direction by contact between the outer surface of the front support portion 42 and the inner surface of the storage chamber 39 and contact between the outer surface of the rear support portion 43 and the inner surface of the storage chamber 39. The front support portion 42 is held by an annular fastener 45 screwed to the inner side of the front end portion of the rotary inner shell 23. Thereby, the transducer 24 and the booster 25 are installed in the rotary inner shell 23 coaxially without being displaced in front and rear directions. The fastener 45 has an annular sealing member 46 made from rubber or synthetic resin in an inner edge portion. The sealing member 46 is brought into contact with the outer surface of the booster 25 to prevent water from entering a space between the fastener 45 and the booster 25. The fastener 45 covers the outer bearing holder 35 with a space smaller than the surface tension of the refrigerant therebetween to prevent the refrigerant from entering the rotary inner shell 23 from the space. The fastener 45 has an unshown recess for a fastening tool so that the fastening tool is inserted into the recess to connect the fastener 45 to the rotary inner shell 23 properly.

An electric supply system to the transducer 24 will be described hereinunder. The transducer 24 is fitted with a conductive cover 47 which is connected to the negative electrode of the transducer 24. A positive transducer terminal 48 is electrically insulated, fixed to the center of the rear end of the cover 47 and connected to the positive terminal of the transducer 24. A rotary connection unit 49 made from an electrical insulating material is screwed to the rear end of the rotary inner shell 23. The rotation connection unit 49 has a positive rotary terminal 50 embedded therein, negative and positive annular rotary terminals 51 and 52 called "slip ring" provided on the outer surface, a negative rotary terminal 53 projecting from the front side, and an annular barrier 54 made from an electric insulating material and projecting from the outer surface to separate the negative and positive annular rotary terminals 51 and 52 from each other. The positive rotary terminal 50 and the positive annular rotary terminal 52 are connected to each other by an unshown conductor embedded in the rotary connection unit 49, and the front side of the positive rotary terminal 50 contacts the positive transducer terminal 48. The negative annular rotary terminal 51 and the negative rotary terminal 53 are connected to each other by a conductor embedded in the rotary connection unit 49, and the negative rotary terminal 53 contacts the outer surface of the cover 47. At a position corresponding to the rotary connection unit 49, the fixed outer shell 22 has a plurality of fixed connection units 55 made from an electric insulating material. Each of the fixed connection units 55 has negative and positive sliding terminals 56 and 57 called "brush", negative and positive elastic members 58 and 59 made from a conductive material for urging the negative and positive sliding terminals 56 and 57 toward the rotary connection unit 49 side, negative and positive wiring terminals 60 and 61, caps 62 and 63 made from an electric insulating material, and an annular groove 64 located between the negative and positive sliding terminals 56 and 57. The negative sliding terminal 56 is pressed by the negative elastic member 58 to contact the negative annular rotary terminal 51 and the positive sliding terminal 57 is pressed by the positive elastic member 59 to contact the positive annular rotary terminal 52.

Therefore, when the positive wiring terminal 61 is connected to the positive output terminal of an ultrasonic wave generator by an unshown wire, a positive passage for the transducer 24 is formed by the positive wiring terminal 61, the positive elastic member 59, the positive sliding terminal 57, the positive rotary terminal 50 and the positive transducer terminal 48. When the negative wiring terminal 60 is connected to the negative output terminal of the ultrasonic wave generator by an unshown wire, a negative passage for the transducer 24 is formed by the negative wiring terminal 60, the negative elastic member 58, the negative sliding terminal 56, the negative rotary terminal 51 and the cover 47. After the positive passage and the negative passage are formed, electric power is supplied from the ultrasonic wave generator to the transducer 24 which in turn generates vertical ultrasonic vibration having a predetermined frequency and outputs it. The barrier 54 prevents powders generated by sliding contact between the negative and positive annular rotary terminals 51 and 52 and the negative and positive sliding terminals 56 and 57 from short-circuiting the negative and positive annular rotary terminals 51 and 52. The groove 64 also prevents powders generated by sliding contact between the negative and positive annular rotary terminals 51 and 52 and the negative and positive sliding terminals 56 and 57 from short-circuiting the negative and positive sliding terminals 56 and 57. Mating between the barrier 54 and the groove 64 optimizes the prevention of a short-circuit caused by the above powders.

The connection structure of the rotary inner shell 23 and the motor 28 is as follows. A shaft member 65 made from an electric insulating material is fastened to the rear portion of the rotary connection unit 49 by a bolt. A front coupling 66 is fitted onto the shaft member 65 so that it turns together with the shaft member 65. The motor 28 is fastened to a rear outer shell 68 attached to the rear portion of the fixed outer shell 22 by bolts. A rear coupling 69 is attached to the output end of the motor 28 so that it turns together with the motor 28. The front coupling 66 and the rear coupling 69 have a projection and a recess so that they mate with each other and turn together. When the motor 28 is driven while the front and rear couplings 66 and 69 mate with each other, the rotation force of the motor 28 is transmitted from the output end of the motor 28 to the rotary inner shell 23 through the front and rear couplings 66 and 69, the shaft member 65 and the rotary connection unit 49, and the rotary inner shell 23 turns.

A box-like cover 70 is screwed to the rear outer shell 68. The cover 70 covers the fixed connection units 55 from the rear outer shell 68 without contact and also covers an intermediate portion of the fixed outer shell 2 without contact. The front portion of the cover 70 is screwed to unshown struts provided on the outer surface of the fixed outer shell 22.

In short, as shown in FIG. 2, the ultrasonic vibration rotation unit 12 has such a simple structure that the booster 25 and the transducer 24 are installed in the rotary inner shell 23 coaxially, the horn 26 having the cutting blade 27 and connected coaxial to the booster 25 is placed on the front outer sides of the rotary inner shell 23 and the fixed outer shell 22, and the motor 28 attached to the rear portion of the fixed outer shell 22 is connected coaxial to the rotary inner shell 23.

Figure 4:
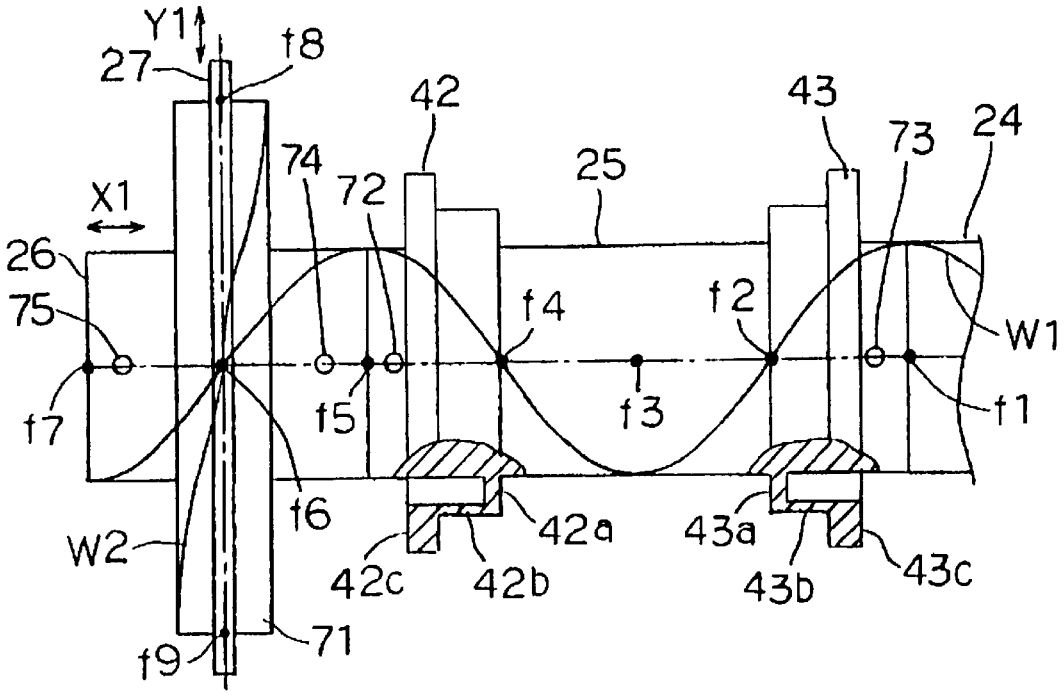
FIG. 4 is a diagram showing the relationship between a resonator and vibration waveform of Embodiment 1.

With reference to FIG. 4, the resonator composed of the booster 25 and the horn 26 will be described. The booster 25 is made from a material having excellent acoustic characteristics such as titanium, aluminum or hardened iron and has a length equal to the wavelength of vibration which resonates with ultrasonic vibration transmitted from the transducer 24, thereby improving the centering of the rotary inner shell 23 and the transducer 24 and the prevention of deflection at the time of cutting. The maximum vibration amplitude points f1 and f5 of the waveform W1 of vibration which resonates with ultrasonic vibration from the transducer 24 are existent at both ends of the booster 25 and the minimum vibration amplitude points f2 and f4 are existent at the front support portion 43 and the rear support portion 43 of the booster 25. The vibration waveform W1 shows the instantaneous displacement (vibration amplitude) of ultrasonic vibration caused by resonance.

The front support portion 42 has an annular root portion 42*a* projecting outward from the minimum vibration amplitude point f4 of the vibration waveform W1 in a radial direction, a cylindrical thin portion 42*b* extending from the end of the root portion 42*a* toward the horn 26 side, and an annular thick portion 42*c* projecting outward from the end of the thin portion 42*b* in a radial direction. The rear support portion 43 has an annular root portion 43*a* projecting outward from the minimum vibration amplitude point f2 in a radial direction, a cylindrical thin portion 43*b* extending from the end of the root portion 43*a* toward the transducer 24 side, and an annular thick portion 43*c* projecting outward from the end of the thin portion 43*b* in a radial direction. The outer surfaces of the thick portions 42*c* and 43*c* are wholly contacted to the inner wall of the storage chamber 39 of the rotary inner shell 23, whereby the support span in front and rear directions of the booster 25 by the rotary inner shell 23 becomes long, thereby further improving the prevention of deflection at the time of cutting. The root portions 42*a* and 43*a* are thicker than the thin portions 42*b* and 43*b*, and the thick portions 42*c* and 43*c* are thicker than the thin portions 42*b* and 43*b*.

The horn 26 is made from a material having excellent acoustic characteristics such as titanium, aluminum or hardened iron and has a length equal to ½ the wavelength of vibration which resonates with ultrasonic vibration transmitted from the transducer 24. The maximum vibration amplitude points f5 and f7 of the vibration waveform W1 are existent at both ends of the horn 26. The vibration transmission direction converter 71 and the cutting blade 27 are existent at the minimum vibration amplitude point f6 of the vibration waveform W1 in the horn 26. The horn 26 and the booster 25 excluding the vibration transmission direction converter 71 vibrate in an axial direction shown by an arrow X1.

The vibration transmission direction converter 71 has a diameter larger than that of the horn 26 and a width which is equally divided with the minimum vibration amplitude point f6 as a center, is circular and coaxial to the horn 26, and changes the transmission direction of vibration from an axial direction to a radial direction. The maximum vibration amplitude points f8 and f9 of a vibration waveform W2 which shows the instantaneous displacement (vibration amplitude) of ultrasonic vibration whose transmission direction has been changed to a radial direction are existent at the peripheral portion of the vibration transmission direction converter 71. The cutting blade 27 is located at the minimum vibration amplitude point f6 and has a diameter larger than that of the vibration transmission direction converter 71, and the edge of the cutting blade 27 vibrates in a radial direction shown by an arrow Y1. The vibration of the edge of the blade in a radial direction is determined by the projection amount of the edge from the vibration transmission direction converter 71. That is, when the diameter of the cutting blade 27 is much larger than the diameter of the vibration transmission direction converter 71, the edge of the blade also vibrates in a direction shown by the arrow X1. Therefore, the diameter of the cutting blade 27 is set to a range that it vibrates only in a direction shown by the arrow Y1 based on the diameter of the vibration transmission direction converter 71.

The outer surface excluding the front and rear support portions 42 and 43 of the booster 25 and the outer surface excluding the vibration transmission direction converter 71 of the horn 26 have recesses 72, 73, 74 and 75 into which a tool is inserted to connect or disconnect the booster 25 to or from the transducer 24, or connect or disconnect the booster 25 to or from the horn 26.

Figure 5:
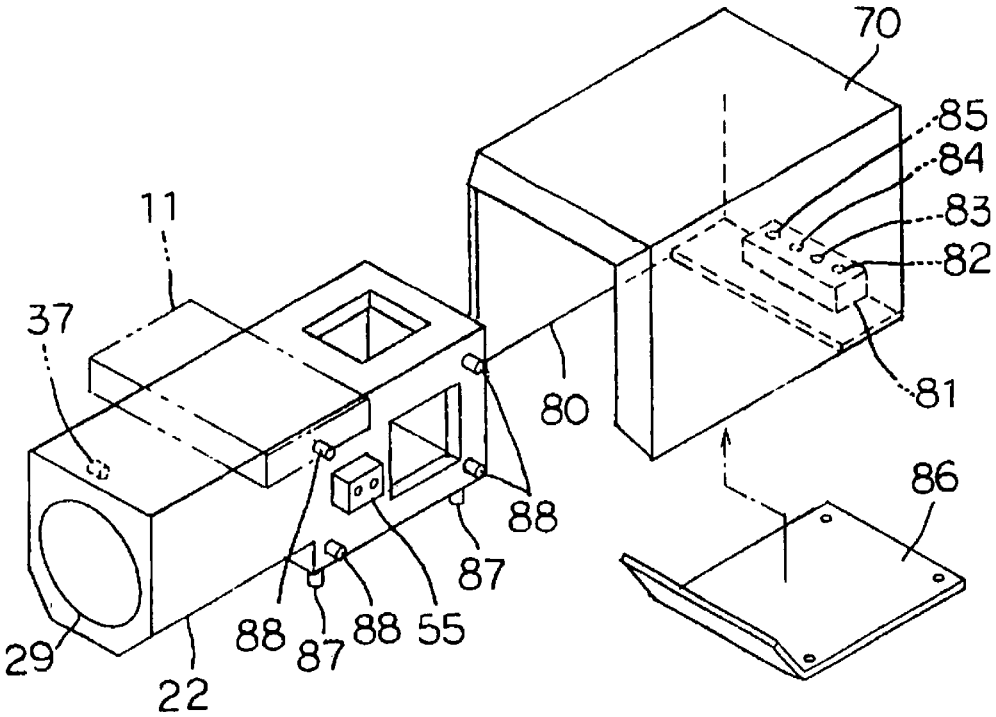
FIG. 5 is an explosive perspective view of a fixed outer shell and a rear outer shell of Embodiment 1.

With reference to FIG. 5, the fixed outer shell 22 and the cover 70 will be described. The cover 70 has an opening 80 in a front portion of the bottom and a terminal substrate 81 in a rear portion of the bottom. The terminal substrate 81 has a positive terminal 82 and a negative terminal 83 for the transducer and a positive terminal 84 and a negative terminal 85 for the motor in a synthetic resin base portion. When the cover 70 is placed on the fixed outer shell 22, the positive terminal 82 for the transducer and the positive wiring terminal 61 of the fixed connection unit 55 are connected to each other, the negative terminal 83 for the transducer and the negative wiring terminal 60 of the fixed connection unit 55 are connected to each other, the positive terminal 84 for the motor and the positive terminal of the motor 28 are connected to each other, and the negative terminal 85 for the motor and the negative terminal of the motor 28 are connected to each other by unshown respective wires placed in an inner space covered by the cover 70. The positive terminal 82 for the transducer and the negative terminal 83 for the transducer are connected to the positive output terminal and the negative output terminal of the unshown ultrasonic wave generator by wires from the outside of the cover 70, respectively. The positive terminal 84 for the motor and the negative terminal 85 for the motor are connected to the positive output terminal and the negative output terminal of an unshown motor drive circuit by wires from the outside of the cover 70, respectively. After the end of wiring work between the above terminals and wires, a cover 86 is screwed to the fixed outer shell 22 through a plurality of struts 87 to close the opening 80. Thereby, the above wiring is carried out using the opening 80 with ease. By closing the opening 80 with the cover 86, an accident such as an electric shock can be prevented. A plurality of struts 88 are existent on the opposite side wall like a plurality of struts 88 projecting from the side wall of the fixed outer shell 22 and members for screwing the cover 70 to the fixed outer shell 22 without interfering with the fixed connection units 55.

Figure 6:
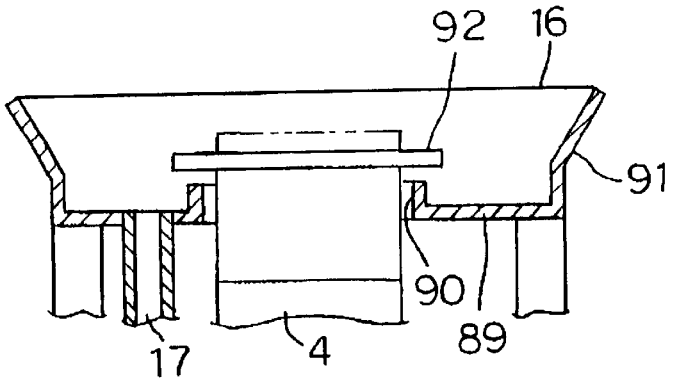
FIG. 6 is a sectional view of a refrigerant receiver of Embodiment 1.

With reference to FIG. 6, the refrigerant receiver 16 will be described. The refrigerant receiver 16 is shaped like a dish, consists of an annular bottom portion 89 surrounding the mounting table 4 with a space therebetween, an inner wall 90 rising from the inner edge of the bottom portion 89 and an outer wall 91 rising from the outer edge of the bottom portion 89, and has a refrigerant return passage 17 in the bottom portion 89. The inner wall 90 has an inner diameter smaller than the outer diameter of a table 92 which is the top surface for mounting the part to be cut of the mounting table 4 and can guide the refrigerant falling from the part through the table 92 into the bottom portion 89 properly in such a manner that the refrigerant does not go into the apparatus body 1. The outer wall 91 has an inner diameter larger than the outer diameter of the table 92. The top end of the outer wall 91 is located above the table 92 and can guide the refrigerant scattered from the turning cutting blade 27 into the bottom portion 89 properly if it is located above the part to be cut shown by a virtual line and mounted on the table 92. Therefore, the outer wall 91 is the best for preventing the scattering of the refrigerant.

Figure 7:
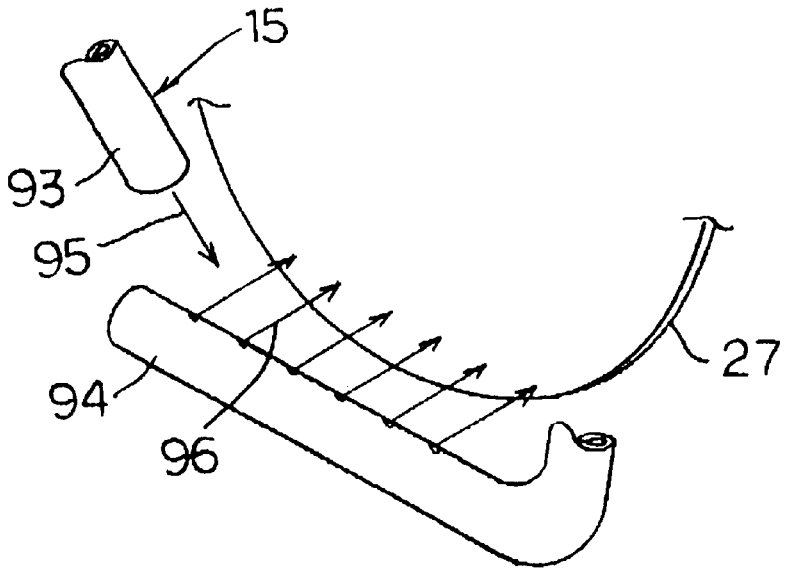
FIG. 7 is a perspective view of a nozzle unit of Embodiment 1.

With reference to FIG. 7, the nozzle unit 15 will be described. The nozzle unit 15 has a nozzle 93 on the part side and a nozzle 94 on the cutting blade side in a base portion attached to either one of the holder 11 and the ultrasonic vibration rotation unit 12. The nozzle 93 on the part side spays the refrigerant 95 from the end upon the part to be cut on the cutting side of the cutting blade 28 as shown by an arrow, and the nozzle 94 on the cutting blade side sprays the refrigerant 96 from the side portion upon a part cutting portion of the cutting blade 27 as shown by arrows. Therefore, the refrigerants 95 and 96 are fully supplied to contact portions of the cutting blade 27 and the part to be cut so that the cutting blade 27 and the part to be cut can be cooled with the refrigerants 95 and 96 properly. Particularly when the part to be cut is a semiconductor wafer, IC parts integrated on the semiconductor wafer are protected from cutting heat.

The operation of Embodiment 1 will be described. In FIG. 1, a semiconductor wafer incorporating IC's as the part to be cut is fixed on the mounting table 4. When an operator operates an unshown operation board provided on the apparatus body 1 and instructs the control unit 100 to start cutting, the control unit 100 instructs a CCD camera 99 to start picking up an image of the semiconductor wafer. The CCD camera 99 outputs an image signal for the semiconductor wafer on the mounting table 4 to the control unit 100 which then outputs displacement which is a calculation result obtained based on the image signal and reference image information to the mounting table 4. The rotation angle θ control function of the mounting table 4 works to complete the alignment of the semiconductor wafer with the ultrasonic vibration rotation unit 12. Thereafter, the control unit 100 controls the 3-axis drive unit 5, the ultrasonic vibration rotation unit 12 and the cooling system 13 so that the cutting blade 27 shown in FIG. 2 of the ultrasonic vibration rotation unit 12 turns in one direction and resonates with ultrasonic vibration, the nozzle unit 15 sprays the refrigerant, and the holder 11 of the 3-axis drive unit 5 moves in a direction X and a direction Z to draw a rectangular locus. After the first rectangular locus is drawn, the cutting blade 27 of the ultrasonic vibration rotation unit 12 cuts the semiconductor wafer for the first time in one direction. After this cutting, the holder 11 of the 3-axis drive unit 5 moves in a direction Y and draws a rectangular locus again, whereby the cutting blade 27 of the ultrasonic vibration rotation unit 12 cuts the semiconductor wafer for the second time in one direction. After this cutting, the holder 11 of the 3-axis drive unit 5 moves in the direction Y again and draws a rectangular locus repeatedly, whereby the semiconductor wafer is cut into multiple belts. When the cutting of belts is completed, the control unit 100 instructs the mounting table 4 to turn at 90° and the rotation angle θ control function of the mounting table 4 works so that the direction of the semiconductor wafer is changed at 90° with respect to the ultrasonic vibration rotation unit 12. In this state, the control unit 100 resumes the control of the 3-axis drive unit 5 and the cutting blade 27 cuts the belt-like semiconductor wafer into multiple dice forms, thereby completing the cutting work of one semiconductor wafer by the ultrasonic vibration rotation unit 12.

Embodiment 2

Figure 8:
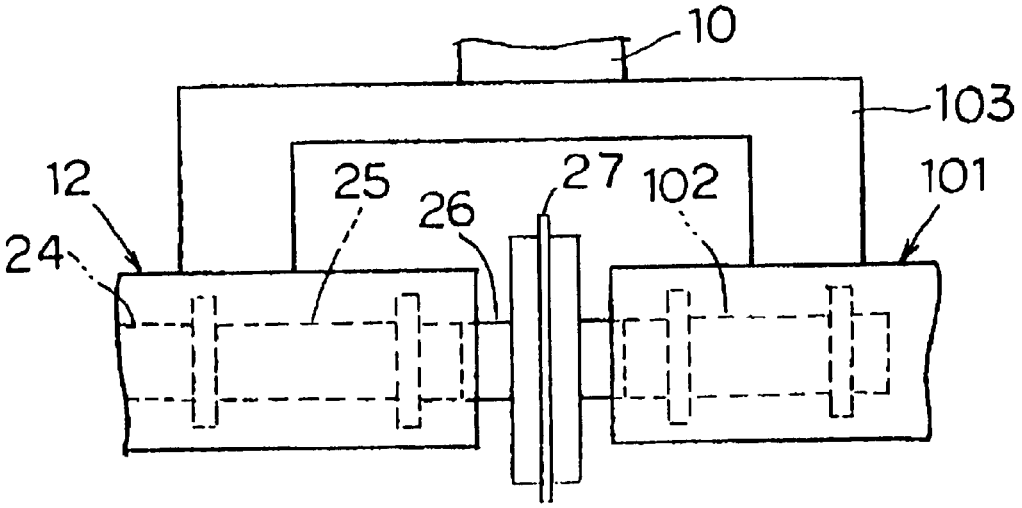
FIG. 8 is a side view of Embodiment 2 of the present invention.

With reference to FIG. 8, Embodiment 2 of the present invention will be described. Both the ultrasonic vibration rotation unit 12 and an auxiliary ultrasonic vibration rotation unit 101 are used and the auxiliary ultrasonic vibration rotation unit 101 stores a booster 102 corresponding to the above booster 25 in such a manner that the booster 102 can turn. When the booster 102 is connected coaxial to the other end of the horn 26 having the cutting blade 27 of the ultrasonic vibration rotation unit 12 by a screw such as a headless screw, the ultrasonic vibration rotation unit 12 and the auxiliary ultrasonic vibration rotation unit 101 are both held by a fork-like holder 103 corresponding to the above holder 11. The present invention can be applied in the same manner as in Embodiment 1.

In the above Embodiment 1, the semiconductor wafer is used as the part to be cut. The part to be cut may be a viscous and soft material such as gold, silver, aluminum, solder or copper, a hard and fragile material such as ceramic, silicon or ferrite, a laminate structure consisting of a synthetic resin and a metal, or a laminate structure consisting of an inorganic material, a metal and a synthetic resin.

As described above, according to the first aspect of the present invention, the part to be cut is mounted and fixed on the mounting table, the ultrasonic vibration rotation unit is moved down, stopped when the cutting blade of the ultrasonic vibration rotation unit reaches a position for cutting the part, and moved linearly for cutting, and the cutting blade is turned and vibrated with ultrasonic waves to cut the part. Thus, the part can be properly cut by ultrasonic vibration rotation.

According to the second aspect of the present invention, when the 3-axis drive unit and the ultrasonic vibration rotation unit are operated after the part to be cut is fixed on the mounting table, the cutting blade of the ultrasonic vibration rotation unit is turned in one direction and vibrated with ultrasonic waves, the 3-direction output portion of the 3-axis drive unit draws a rectangular locus, and the cutting blade of the ultrasonic vibration rotation unit can cut the part.

According to the third aspect of the present invention, since the cooling means cools the cutting blade of the ultrasonic vibration rotation unit and the part to be cut, the part can be protected from being damaged by cutting heat.

According to the fourth aspect of the present invention, the resonator is stored in the rotary inner shell, the cutting blade is existent at the minimum vibration amplitude point projecting outward from one ends of the fixed outer shell and the rotary inner shell of the resonator, and the drive source attached to the other end of the fixed outer shell turns the rotary inner shell. Therefore, it is possible to simplify the structure of the ultrasonic vibration rotation unit.

What is claimed is:

1. An ultrasonic vibration cutting method comprising the steps of:

mounting and fixing a part to be cut on a mounting table;

moving down an ultrasonic vibration rotation unit:

stopping the downward movement of the ultrasonic vibration rotation unit when the cutting blade of the ultrasonic vibration rotation unit reaches a position for cutting the part;

moving the ultrasonic vibration rotation unit linearly for cutting; and turning and vibrating the cutting blade with ultrasonic waves to cut the part.

2. An ultrasonic vibration cutting apparatus comprising:

a mounting table attached to an apparatus body to fix a part to be cut;

a 3-axis drive unit which is attached to the apparatus body and can move linearly in three directions perpendicular to one another; and an ultrasonic vibration rotation unit attached to the 3-direction output portion of the 3-axis drive unit to cut the part fixed on the mounting table.

3. The ultrasonic vibration cutting apparatus of claim 2 which further comprises cooling means for cooling the cutting blade of the ultrasonic vibration rotation unit and the part to be cut.

4. The ultrasonic vibration cutting apparatus of claim 2, wherein the ultrasonic vibration rotation unit comprises a fixed outer shell attached to the 3-direction output portion of the 3-axis drive unit, a rotary inner shell installed in the fixed outer shell rotably, a transducer stored in the rotary inner shell, a circular resonator connected to the transducer and arranged coaxial to the rotary inner shell, a cutting blade projecting outward from one ends of the fixed outer shell and the rotary inner shell of the resonator and provided at the minimum vibration amplitude point, and a drive source attached to the other end of the fixed outer shell to turn the rotary inner shell.

* * * * *